US005493381A

United States Patent [19]

Lange et al.

[11] Patent Number: 5,493,381

[45] Date of Patent: Feb. 20, 1996

[54] OPTIMIZING PRECLEAN CORONA CURRENT FOR CLEANING MULTIPLE TONERS

[75] Inventors: Clark V. Lange, Ontario; Robert P. Siegel, Penfield, both of N.Y.

[73] Assignee: Xerox Corporation, Stamford, Conn.

[21] Appl. No.: 323,557

[22] Filed: Oct. 17, 1994

Related U.S. Application Data

[63] Continuation-in-part of Ser. No. 166,372, Dec. 13, 1993.

[51] Int. Cl.[6] ..... G03G 21/00

[52] U.S. Cl. ..... 355/296; 15/1.51; 355/303

[58] Field of Search ..... 355/219, 296, 355/299–301, 303; 118/652; 15/1.51

[56] References Cited

U.S. PATENT DOCUMENTS

| | | | |
|---|---|---|---|
| 4,615,613 | 10/1986 | Garsin | 355/303 |
| 5,175,584 | 12/1992 | Usui | 355/296 X |
| 5,175,590 | 12/1992 | Frankel et al. | 355/296 |
| 5,206,687 | 4/1993 | Suzuki et al. | 355/214 |
| 5,303,009 | 4/1994 | Nishizawa | 355/219 |

*Primary Examiner*—William J. Royer
*Attorney, Agent, or Firm*—T. L. Fair

[57] ABSTRACT

A method and apparatus for adjusting the preclean corona current used in a printer or digital copier such that the preclean corona current is optimized for the dominant color entering the cleaner.

18 Claims, 5 Drawing Sheets

OPTIMIZING PRECLEAN CORONA CURRENT FOR CLEANING MULTIPLE TONERS

This is a continuation in part of copending U.S. application Ser. No. 08/166,372 entitled "Optimizing Cleaner Bias for Cleaning Multiple Toners", filed Dec. 13, 1993 by the same inventors and the same assignee, which is incorporated by reference herein.

BACKGROUND OF THE INVENTION

This invention relates generally to an electrostatographic printing or copying machine which utilizes multiple toners, such as in the formation of multi-color images and more particularly, to cleaning systems using preclean corona current to assist in removing toner and additive film particle buildup on the photoconductive (i.e. imaging) member.

In a colored image forming apparatus, an electrostatic latent image which is to be developed by a predetermined color is formed on a photoconductor by an optical system of a copying machine or printer. Then, the electrostatic latent image is developed by a developing unit which accommodates a predetermined colored toner to be used for development. This toner image may be subsequently transferred to a support surface such as copy paper or other medium to which it may be permanently affixed by heating or by the application of pressure. After each transfer process, the toner and other debris particles (i.e. residual particles) remaining on the photoconductor are removed from the photoconductor by a cleaning device.

The preclean latitude of a cleaner is defined by evaluating performance at a number of preclean current values. A setpoint is chosen by stressing the input to the cleaner and choosing the point upon which the latitude converges. This is a fairly straightforward process when single toner type systems are used. However, when multiple toner types are used a problem is encountered because of the potential for the latitudes to converge to different preclean current setpoints. This has been observed, for example, in cleaning latitude tests conducted on a Xerox 5090 with one color station added. In the Xerox 5090, the additional color station developed red toner as highlight color. The black toner preclean current setpoint convergence was different than for the red toner in the Xerox 5090 machine.

The following disclosure may be relevant to various aspects of the present invention and may be briefly summarized as follows:

U.S. Pat. No. 5,206,687 to Suzuki et al. discloses a cleaning device having a doctor blade for peeling off toner, that has been de-electrified by the preclean corotron, from the photoreceptor drum.

SUMMARY OF INVENTION

Briefly stated, and in accordance with one aspect of the present invention, there is provided a method for cleaning particles from an imaging surface, comprising: determining the color of the particles developed on the imaging surface; and changing the charge on the particles, in response to the color of the particles determined by the determining step, enabling optimal removal of the particles from the imaging surface.

Pursuant to another aspect of the present invention, there is provided an apparatus for removing particles from an imaging surface, comprising: means for determining the color of the particles developed on the imaging surface; and means for changing the charge on the particles for removal of the particles from the imaging surface.

BRIEF DESCRIPTION OF THE DRAWINGS

Other features of the present invention will become apparent as the following description proceeds and upon reference to the drawings, in which.

While the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

DETAILED DESCRIPTION OF THE INVENTION

For a general understanding of a color electrostatographic printing or copying machine in which the present invention may be incorporated, reference is made to U.S. Pat. Nos. 4,599,285 and 4,679,929, whose contents are herein incorporated by reference, which describe the image on image process having multi-pass development with single pass transfer. The present invention can also be used in tri-level xerography which is subsequently described in FIG. 5. Although the cleaning method and apparatus of the present invention is particularly well adapted for use in a color electrostatographic printing or copying machine, it should become evident from the following discussion, that it is equally well suited for use in a wide variety of devices and is not necessarily limited to the particular embodiments shown herein.

Figure 5:
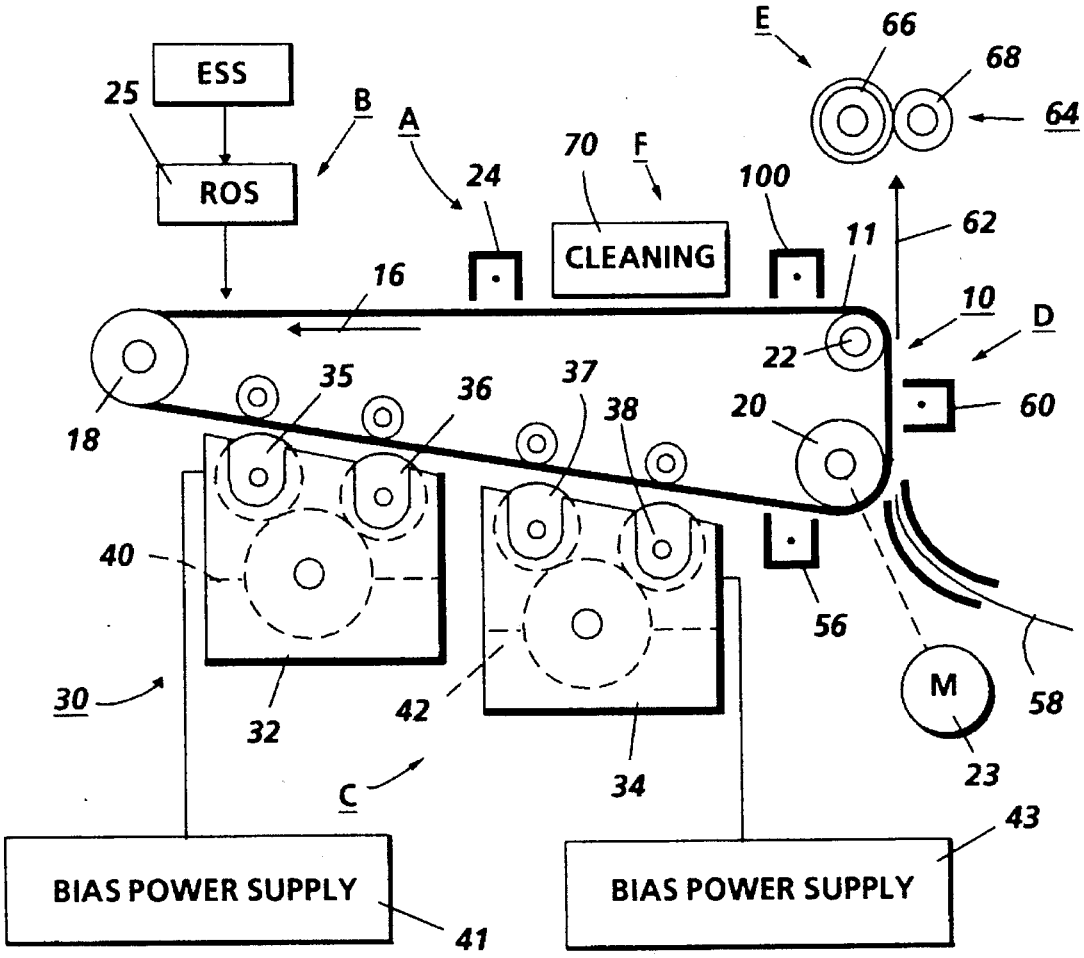
FIG. 5 is a schematic illustration of a printing apparatus incorporating the inventive features of the present invention.

Referring now to the drawings, where the showings are for the purpose of describing a preferred embodiment of the invention and not for limiting same, the various processing stations employed in the reproduction machine illustrated in FIG. 5 will be briefly described.

A tri-level reproduction machine, in which the present invention finds advantageous use, utilizes a charge retentive member in the form of a photoconductive belt 10 consisting of a photoconductive surface and an electrically conductive, light transmissive substrate mounted for movement past a charging station A, an exposure station B, developer stations C, transfer station D, fusing station E and cleaning station F. Belt 10 moves in the direction of arrow 16 to advance successive portions thereof sequentially through the various processing stations disposed about the path of movement thereof. Belt 10 is entrained about a plurality of rollers 18, 20 and 22, the former of which can be used to provide suitable tensioning of the photoreceptor belt 10. Motor 23 rotates roller 20 to advance belt 10 in the direction of arrow 16. Roller 20 is coupled to motor 23 by suitable means such as a belt drive.

Figure 4:
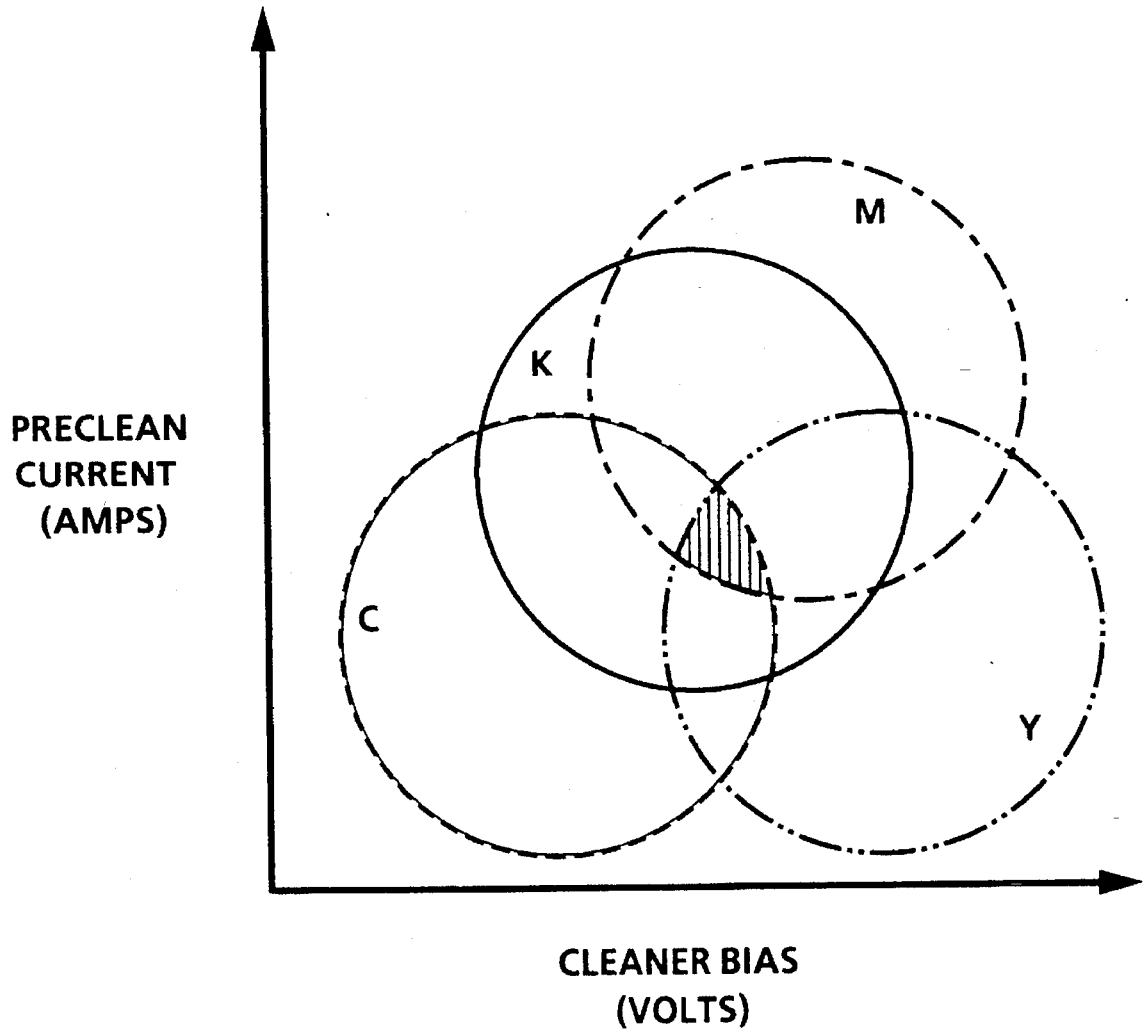
FIG. 4 is a graphic diagram of the color latitudes.

As can be seen by further reference to FIG. 4, initially successive portions of belt 10 pass through charging station A. At charging station A, a corona discharge device such as a scorotron, corotron or dicorotron indicated generally by the reference numeral 24, charges the belt 10 to a selectively high uniform positive or negative potential. Any suitable control, well known in the art, may be employed for controlling the corona discharge device 24.

Next, the charged portions of the photoreceptor surface are advanced through exposure station B. At exposure station B, the uniformly charged photoreceptor or charge retentive surface 10 is exposed to a laser based input and/or output scanning device 25 which causes the charge retentive surface to be discharged in accordance with the output from the scanning device. Preferably the scanning device is a three level laser Raster Output Scanner (ROS). The resulting photoreceptor contains both charged-area images and discharged-area images as well as charged edges corresponding to portions of the photoreceptor outside the image areas. [The high voltage latent image is developed with positive (+) charged black toner and is called Charge Area Development (CAD). The low voltage latent image is developed with negative (–) charge color toner and Discharge Area Development (DAD)].

The photoreceptor, which is initially charged to a voltage undergoes dark decay to a voltage level. When exposed at the exposure station B it is discharged to near zero or ground potential in the highlight (i.e. color other than black) color parts of the image. The photoreceptor is also partially discharged in the background (white) image areas. After passing through the exposure station, the photoreceptor contains charged areas and discharged areas which corresponding to two images and to charged edges outside of the image areas.

At development station C, a development system, indicated generally by the reference numeral 30 advances developer materials into contact with the electrostatic latent images. The development system 30 comprises first and second developer apparatuses 32 and 34. The developer apparatus 32 comprises a housing containing a pair of magnetic brush rollers 35 and 36. The rollers advance developer material 40 into contact with the photoreceptor for developing the discharged-area images. The developer material 40, by way of example, contains negatively charged color toner. Electrical biasing is accomplished via power supply 41 electrically connected to developer apparatus 32. A DC bias is applied to the rollers 35 and 36 via the power supply 41.

The developer apparatus 34 comprises a housing containing a pair of magnetic brush rolls 37 and 38. The rollers advance developer material 42 into contact with the photoreceptor for developing the charged-area images. The developer material 42 by way of example contains positively charged black toner for developing the charged-area images. Appropriate electrical biasing is accomplished via power supply 43 electrically connected to developer apparatus 34. A DC bias is applied to the rollers 37 and 38 via the bias power supply 43.

Because the composite image developed on the photoreceptor consists of both positive and negative toner, a pretransfer corona discharge member 56 is provided to condition the toner for effective transfer to a substrate using corona discharge of a desired polarity, either negative or positive.

Sheets of substrate or support material 58 are advanced to transfer station D from a supply tray, not shown. Sheets are fed from the tray by a sheet feeder, also not shown, and advanced to transfer station D through a corona charging device 60. After transfer, the sheet continues to move in the direction of arrow 62 to fusing station E.

Fusing station E includes a fuser assembly, indicated generally by the reference numeral 64, which permanently affixes the transferred toner powder images to the sheets. Preferably, fuser assembly 64 includes a heated fuser roller 66 adapted to be pressure engaged with a backup roller 68 with the toner powder images contacting fuser roller 66. In this manner, the toner powder image is permanently affixed to the sheet.

After fusing, copy sheets are directed to catch tray, not shown or a finishing station for binding, stapling, collating etc., and removal from the machine by the operator. Alternatively, the sheet may be advanced to a duplex tray (not shown) from which it will be returned to the processor for receiving a second side copy. A lead edge to trail edge reversal and an odd number of sheet inversions is generally required for presentation of the second side for copying. However, if overlay information in the form of additional or second color information is desirable on the first side of the sheet, no lead edge to trail edge reversal is required. Of course, the return of the sheets for duplex or overlay copying may also be accomplished manually.

Residual toner and debris remaining on photoreceptor belt 10 after each copy is made, may be removed at cleaning station F with a blade, brush or other type of cleaning system 70. A preclean corotron 100 is provided to condition or charge the toner particles for easier removal from the photoconductor surface.

Figure 1:
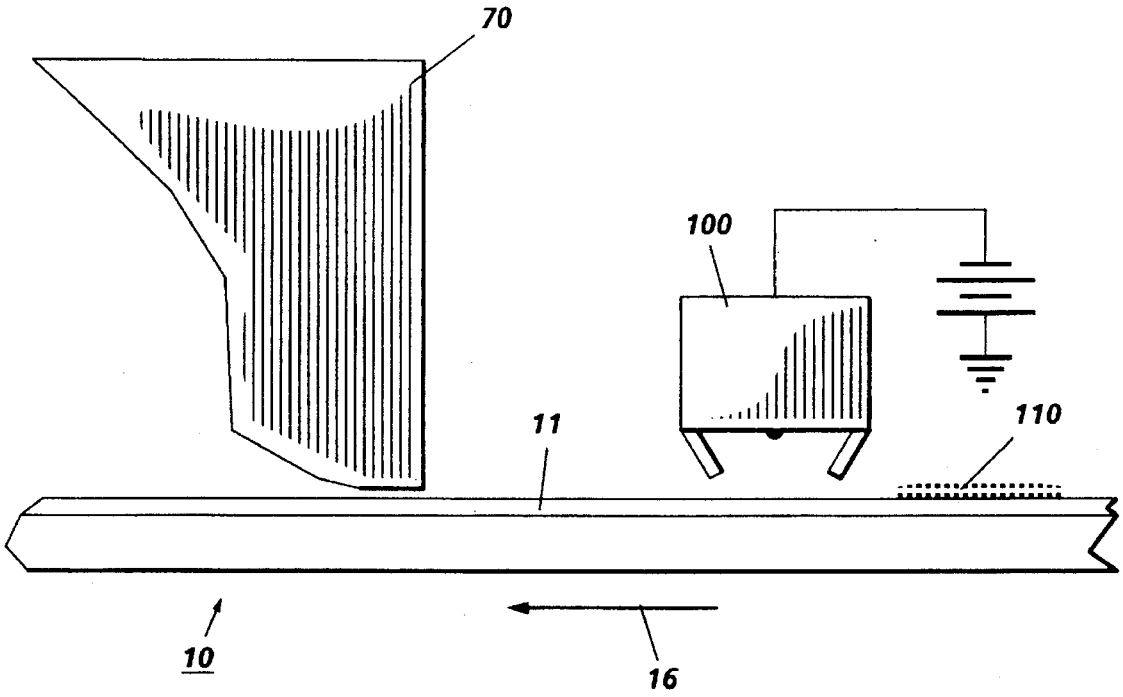
FIG. 1 is a schematic elevational view showing a blade cleaning system with a preclean current applied to a corotron.

Referring now to FIG. 1 which shows a cleaning system 70 with a preclean corona device 100 and a cleaning device. The preclean corotron 100 has a current (i.e. AC or DC) applied to it's coronode such that, when activated, the ionized air charges the toner 110 passing beneath the preclean corotron on the imaging surface 11.

With continued reference to FIG. 1, the preclean corotron 100 changes the charge on the residual particles on the imaging surface to allow easier removal of the particles and debris by the cleaning system (e.g. mechanical or biased brush, or blade or an air vacuum being the primary cleaner). The residual toner particles and other waste material cleaned from the imaging surface 11 are carried out of the housing and transported into a waste container (not shown).

Figure 2:
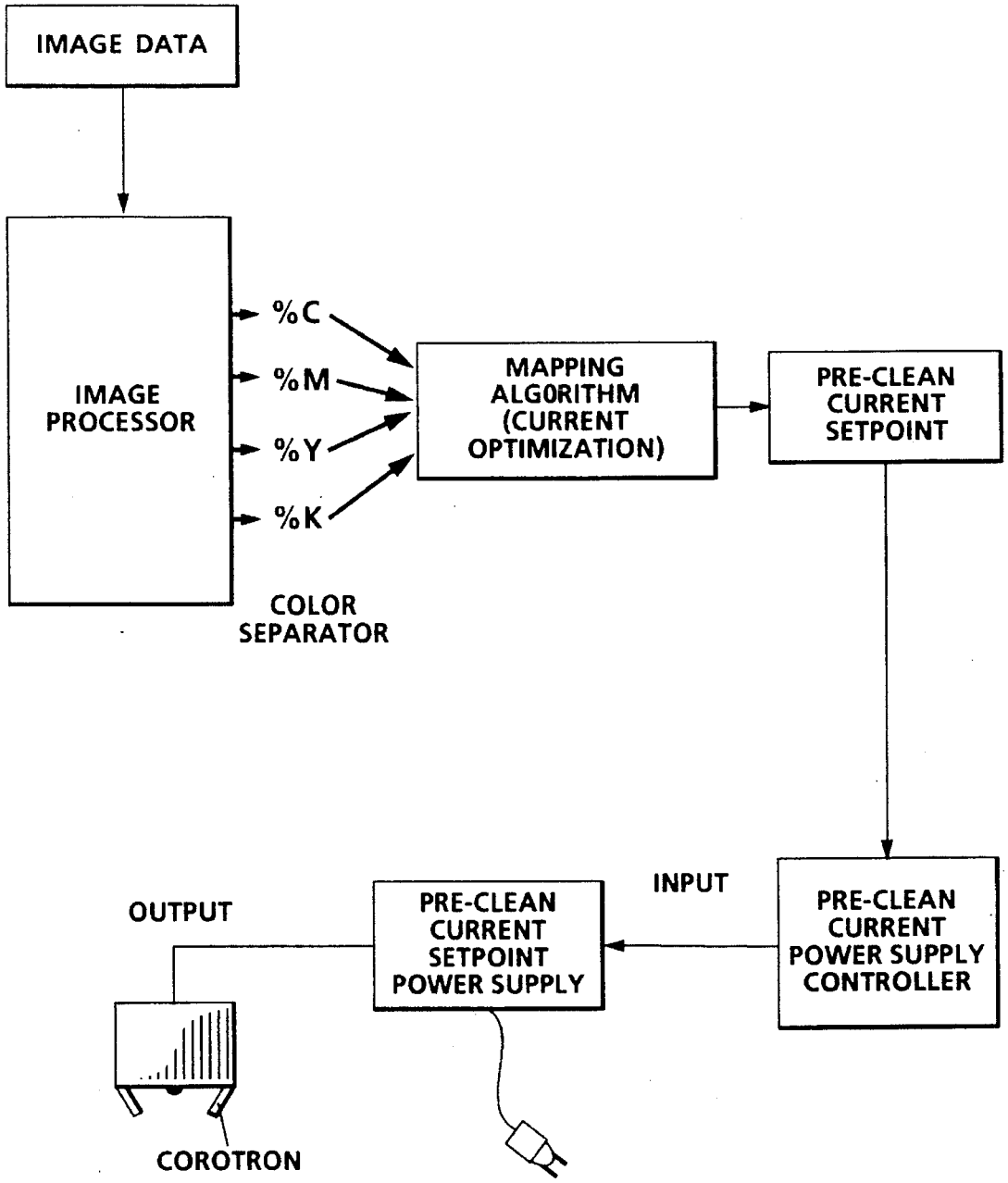
FIG. 2 is a block diagram of the process used in the present invention.

To provide an overview of the image-on-image process in which the present invention is incorporated, reference is now made to FIG. 2, which shows a flow chart of the process. The Image Data is processed in an Image Processor which separates the color pixels into cyan, magenta, yellow and black. A printer or a copier may be used in the present invention. They only differ in how each reaches the color separation of the pixels. In a printer operation, a network feeds information or imaged data to a printer in Page Description Language (PDL). The image is then processed where it is decomposed then converted to cyan, magenta, yellow and/or black via a color separator. In a digital copier, the image is scanned in from a document and converted into cyan, magenta, yellow and black by an Image Processor. The dominant color among those exiting the Color Separator can be determined, for example, by a pixel counting algorithm, which is a technique that is commonly employed to monitor toner usage in the developer systems. Examples of pixel counting techniques are described in U.S. Pat. Nos. 5,204,698 and 5,204,699, whose contents are incorporated herein by reference. (Other methods of determining the dominant color, besides pixel counting include the use of a color densitometer or some type of sensor to pick up the dominant color.) In the light lens case, where the image data is not directly available in a digital form, an optical sensor, such as the type which is currently used to monitor image density or area coverage could be used to determine the approximate color distribution.

With continued reference to FIG. 2, the present invention adjusts the Preclean Current Setpoint when it is used in a printer or digital copier such that the preclean current is optimized for the dominant color entering the cleaner. (The dominant color is the primary toner color that comprises the majority of the image being cleaned from the photoconductive surface.) The preclean current level can be adjusted per image and also within the image, meaning that the dominant color is determined from image to image and, in some cases, for different portions of the same image. One particularly stressful case for any type of cleaning system is the removal of the high density solid area patches which are occasionally developed for use in process control. This is particularly stressful to the cleaner because these images are not being transferred to paper, so all of the toner must be removed by the cleaner. In the present invention, the dominant color pixel data is transmitted to an IOT controller. The IOT controller processes the information through a microprocessor to supply the appropriate preclean current to the preclean corotron. In the case of a color IOT, these patches will occur in each of four toner colors: cyan, magenta, yellow and black (C,M,Y, and K, respectively). Using the variable preclean current scheme described in this application, it is possible to set the preclean current directly to the optimal set point for each individual color, thus achieving the maximum cleaning effectiveness in the situation where it is needed most. The image definition could be accomplished by pixel counting. In the case where no dominant color exists (i.e. the pixel counts for more than one color are close in value), the preclean current is set to the best compromise setting among the color pixels. Cleaning optimization for any combination of colors would also be possible.

Continuing reference to FIG. 2, the range over which the preclean current would be adjusted would be relatively small (e.g. probably less than 30 μA) and the time would be fairly long as compared to the capacitive time constant of a typical corotron. For example, a time span of approximately 100 msec at 10 ips (inches per second) process speed is required to make an adjustment in 1 inch of photoreceptor (i.e. imaging surface) travel. The Image Processor has already determined the dominant color pixels of the image and it provides this information to the Microprocessor so that the proper preclean current is applied to remove the dominant color particles from the imaging surface when the particles reach the cleaner. The combination of speed and distance are used to inform the cleaner at what point the appropriate bias should be applied. This should not place unreasonable constraints on the power supply design.

The present invention has application to the color engines that are presently being developed and that will be developed in the future. Preclean corona treatment is used for many types of cleaning systems, including mechanical brush cleaners, electrostatic brush cleaners and blade cleaners. It should be noted that in the present invention, the cleaner (e.g. brush) can either be electrically biased in conjunction with the preclean corotron adjustment for cleaning or the cleaner (e.g. blade) can remain passive such that it cannot be adjusted for different cleaning conditions along with the preclean.

Figure 3:
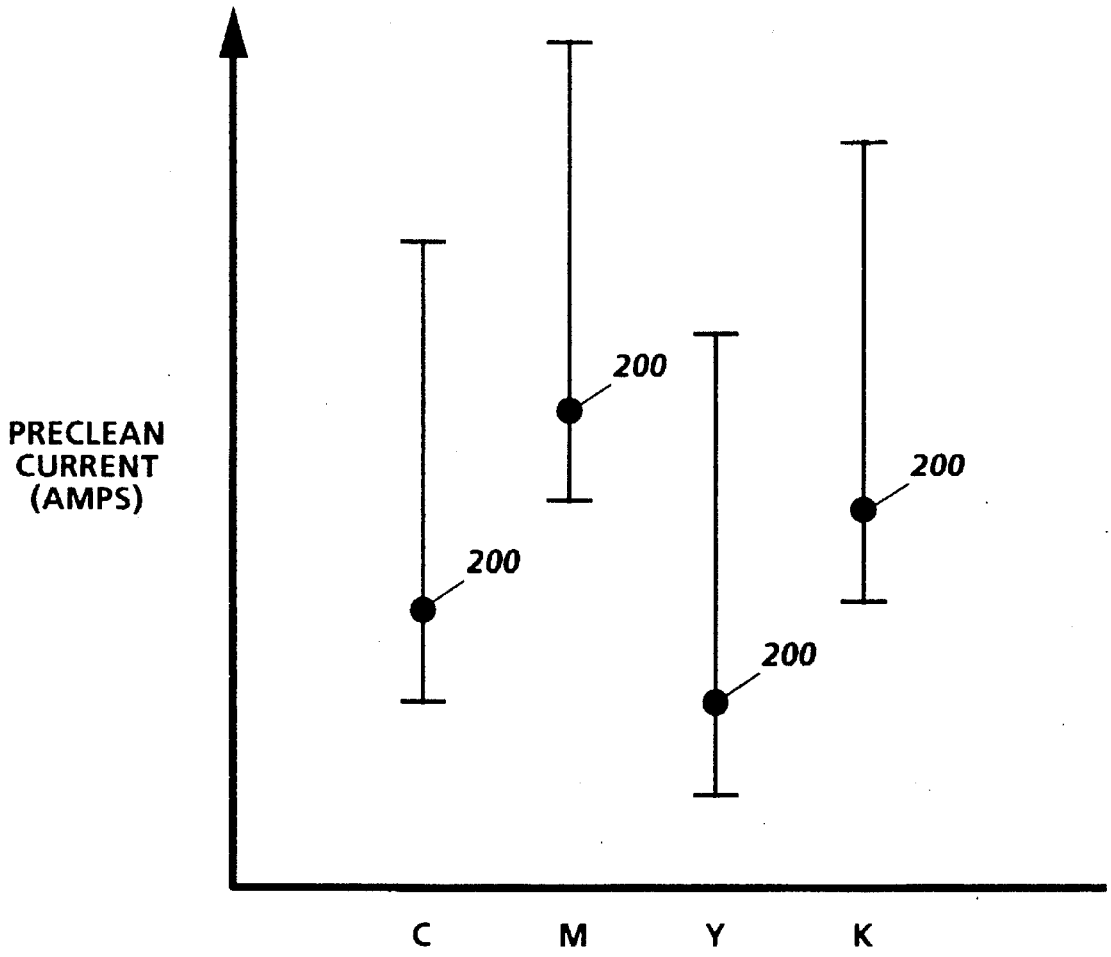
FIG. 3 is a bar diagram of the preclean current vs. color latitudes.

Reference is now made to FIG. 3 which shows an example of preclean current latitudes, graphically, for cyan (C), magenta (M), yellow (Y), and black (K) toners. The vertical bars represent the latitudes for each of the colors. As can be seen in FIG. 3, the latitudes cover different current ranges for each of the colors. The latitude converges to a single point 200 as the cleaner is stressed, for example, with high mass per unit area input on the photoreceptor. Knowledge of the actual image content allows the system to precisely target the appropriate operating region on a case by case basis to allow for maximum effectiveness of the cleaner. This latitude plot can be expanded to two dimensions in the case of a cleaner that has a bias applied to the cleaning element.

Reference is now made to FIG. 4, which shows an example of these two dimensional cleaning latitudes, graphically, for cyan (C), magenta (M), yellow (Y) and black (K). The horizontal axis represents the bias to be applied to the cleaner, increasing from left to right, to clean these colors from a surface. The vertical axis represent the preclean current needed for proper cleaning. The circular area for each color represents the latitude or the optimum preclean current and cleaner bias combination to achieve optimum cleaning of that color. [Note that although there is a region in which an operating latitude exists for all four colors (see the shaded region in FIG. 4, where the four circles overlap) it is a relatively small region.] There may also be in some cases, a maximum cleaning efficiency for a given color at or near the center of that color's latitude. Knowledge of the actual image content allows the system to precisely target the appropriate operating region on a case by case basis. Thus, in the present invention, when the dominant color is determined, the optimum preclean current is determined from the latitude and this is the preclean current that is applied for cleaning. It is also possible that in the case of a brush or other type of cleaner to which a bias can be applied, and the dominant color is determined, both the optimum preclean current and the optimum cleaner bias are required for cleaning of the surface. It should also be noted that the present invention can also be applied to other types of image forming apparatus such as those in which multi-color images are transferred from the photoreceptor to paper, one color at a time, thus enabling the preclean current to be adjusted to the optimal setpoint for each color to ensure optimal cleaning.

In recapitulation, the present invention provides an adjustable current to the preclean corotron used in a printer or digital copier such that the preclean current is optimized for the dominant color entering the cleaner. One way of determining the dominant color is by pixel counting.

It is, therefore, apparent that there has been provided in accordance with the present invention, an optimizing preclean current apparatus that fully satisfies the aims and advantages hereinbefore set forth. While this invention has been described in conjunction with a specific embodiment thereof, it is evident that many alternatives, modifications, and variations will be apparent to those skilled in the art. Accordingly, it is intended to embrace all such alternatives, modifications and variations that fall within the spirit and broad scope of the appended claims.

It is claimed:

1. A method of cleaning particles from an imaging surface, comprising:

charging the particles on the imaging surface;

developing the particles on the imaging surface;

determining the color of the particles developed on the imaging surface; and changing the charge on the particles, in response to the color of the particles determined by said determining step thereby enabling optimal removal of the particles from the imaging surface.

2. The method of claim 1, further comprising:

recording a latent image on the imaging surface;

developing the latent image on the imaging surface with the particles; and adjusting a preclean current being applied to a corona generator, in response to the color of the particles determined by said determining step.

3. A method of cleaning particles from an imaging surface, comprising:

charging the particles for attraction of the particles onto the imaging surface;

recording a latent image on the imaging surface;

developing the latent image on the imaging surface with the particles;

determining a color of the particles developed on the imaging surface by counting pixels to determine the color of the particles;

adjusting a preclean current being applied to a corona generator, in response to the color of the particles determined by said determining step and changing the charge on the particles, in response to the color of the particles determined by said determining step, enabling optimal removal of the particles from the imaging surface.

4. The method of claim 3, wherein the determining step by counting pixels step comprises processing image data to determine the color of the particles.

5. The method of claim 4, wherein said processing step comprises separating the image data into color pixels to determine a dominant color.

6. The method of claim 5, wherein said determining step further comprises determining a preclean current setpoint for the corona generator.

7. The method of claim 6, wherein said developing step comprises forming the latent image developed with the particles in an imaging region of the imaging surface.

8. The method of claim 7, wherein said developing step comprises developing color patches in a non-imaging region of the imaging surface.

9. The method of claim 8, further comprising transferring the latent image in the imaging region to a medium.

10. The method of claim 9, wherein said adjusting step comprises increasing and decreasing the preclean current to the corona generator as determined by said determining step.

11. The method of claim 10, wherein said using step comprises changing the charge on the particles to loosen the particles for removal from the imaging surface.

12. The method of claim 11, further comprising removing the particles from the imaging surface using a cleaner.

13. An apparatus for removing particles from an imaging surface, comprising:

means for charging the particles;

means for developing the particles on the imaging surface;

means for determining the color of the particles developed on the imaging surface; and means for changing the charge on the particles in response to the color determined by said determining means for removal of the particles from the imaging surface.

14. An apparatus as recited in claim 13, further comprising:

means for recording a latent image on the imaging surface;

means for developing the latent image on the imaging surface with the particles;

means for transferring the latent image to a medium;

means for adjusting a preclean current being applied to a corona generator in response to the color of the particles determined by said determining means; and means for cleaning the particles from the imaging surface after transfer.

15. An apparatus for removing particles from an imaging surface, comprising:

means for charging the particles;

means for recording a latent image on the imaging surface;

means for developing the latent image on the imaging surface with the particles;

means for determining the color of the particles developed on the imaging surface, said determining means comprises means for counting pixels to determine the color of the particles;

means for adjusting a preclean current being applied to a corona generator in response to the color of the particles determined by said determining means;

means for changing the charge on the particles for removal of the particles from the imaging surface; and means for cleaning the particles from the imaging surface.

16. An apparatus as recited in claim 15, wherein said means for counting pixels comprises:

an image processor for processing image data, having color pixels therein; and a color separator, coupled to said image processor, for processing the image data to determine a dominant color of the pixels.

17. An apparatus as recited in claim 16, wherein said determining means comprises means for adjusting the corona generator preclean current.

18. An apparatus as recited in claim 17, wherein said adjusting means comprises a power supply for varying the preclean current with the preclean current being increased and decreased by said power supply as a function of the color of the particles being removed from the imaging surface.

* * * * *